US011439208B1

(12) United States Patent
Chan

(10) Patent No.: US 11,439,208 B1
(45) Date of Patent: Sep. 13, 2022

(54) BUCKLE WITH SPRING CLOSURE

(71) Applicant: Duraflex Hong Kong Limited, Hong Kong (CN)

(72) Inventor: Yick Fai Chan, Hong Kong (CN)

(73) Assignee: Duraflex Hong Kong Limited, Hong Kong (CN)

( * ) Notice: Subject to any disclaimer, the term of this patent is extended or adjusted under 35 U.S.C. 154(b) by 0 days.

(21) Appl. No.: 17/503,608

(22) Filed: Oct. 18, 2021

(51) Int. Cl.
*A44B 11/25* (2006.01)
*A44B 11/04* (2006.01)

(52) U.S. Cl.
CPC ..... *A44B 11/2526* (2013.01); *A44B 11/04* (2013.01); *A44B 11/2546* (2013.01); *Y10T 24/4093* (2015.01)

(58) Field of Classification Search
CPC ..... A44B 11/2526; A44B 11/2546; A44B 11/005; A44B 11/16; A44B 11/00; A44B 11/04; A45C 13/14; A41F 1/008; A41F 15/02; A41F 15/002; A41F 15/00; Y10T 24/4088; Y10T 24/4093; Y10T 24/45319
See application file for complete search history.

(56) References Cited

U.S. PATENT DOCUMENTS 2,212,862 A * 8/1940 Hirsh ..... A44B 11/04 24/336
5,177,837 A * 1/1993 Rekuc ..... A44B 11/00 24/200
5,432,985 A * 7/1995 Bernart ..... A44B 11/04 24/265 AL
9,560,909 B2 * 2/2017 Krpan ..... A45F 5/02

* cited by examiner

*Primary Examiner* — Robert Sandy
*Assistant Examiner* — Rowland Do
(74) *Attorney, Agent, or Firm* — Collard & Roe, P.C.

(57) ABSTRACT

A buckle has a main buckle body having a first side wall, a second side wall, and at least one first slot for receiving a strap, and a top bar connected to the main buckle body at the first side wall and forming a second slot with the main buckle body for receiving a second strap. The second slot is open at a distal end thereof. The top bar has a guide track extending longitudinally therethrough, with the guide track opening into the second slot. A catch is formed on the second side wall adjacent the distal end of the second slot. A spring gate is disposed in the guide track. The spring gate is placed around the catch to close the distal end of the second slot. The spring gate is releasable from the catch by pressing on the top bar until the spring gate clears the catch.

9 Claims, 5 Drawing Sheets

BUCKLE WITH SPRING CLOSURE

BACKGROUND OF THE INVENTION

1. Field of the Invention

This invention relates to a device that allows for releasable connection of a strap to a device or to another strap. In particular, the invention relates to a device that allows for simple and quick attachment and detachment of a loop of a strap to the device, via the use of a spring closure system.

2. The Prior Art

Buckle with spring gate closure systems have been used to attach straps, particularly straps with closed loop ends, to the buckle in a releasable manner. These types of buckles are used when the removal of the strap may be necessary, or can be used as replacement buckles for a broken buckle in which the strap is already sewn in place. The top bar of the buckle has a free end so as to formed an open slot, and is closed via a separate spring gate locking element that is inserted through a hole or holes in the end of the top bar. The locking element is then pressed into position so that it extends around a catch on the buckle body, thus closing the open slot and keeping the strap connected to the buckle. The drawback of this design is that the spring gate locking element, which is generally formed by a wire that is bent into an L-shape at its end to insert through the holes, is not stable under high forces, as the wire can bend, causing the ends to slip out of the holes and release the strap. Furthermore, the spring gate locking element in this design must be bent out of its original shape in order to be inserted into the holes of the buckle, which further destabilizes the design.

SUMMARY OF THE INVENTION

It is therefore an object of the invention to provide a buckle for attaching a strap, in which the locking element cannot be inadvertently removed from the buckle during use and under high forces on the buckle. It is another object of the invention to provide a buckle in which the locking element can be assembled with the buckle in a simple manner without deforming the locking element.

These and other objects are accomplished by a buckle comprising a main buckle body having a first side wall, a second side wall, and at least one first slot for receiving a strap, and a top bar connected to the main buckle body at the first side wall and forming a second slot with the main buckle body for receiving a second strap. The second slot is open at a distal end thereof. The top bar has a guide track extending longitudinally therethrough, with the guide track opening into the second slot. The guide track extends parallel to the second slot. A catch is formed on the second side wall adjacent the distal end of the second slot. A spring gate in the shape of a loop with overlapping end portions is disposed in the guide track. The spring gate is configured to be placed around the catch to close the distal end of the second slot. The spring gate is releasable from the catch by pressing on the top bar until the spring gate clears the catch. The spring gate is attachable to the top bar by sliding the spring gate into the guide track from the second slot and moving the spring gate to the distal end of the top bar. The guide track preferably opens into the second slot at an oblique angle. This enables the spring gate to be assembled with the guide track simple and easily.

There is at least one protrusion extending into the guide track at the distal end of the guide track to keep the spring gate at the distal end of the guide track once it clears the protrusion. By assembling the spring gate to the buckle in this way, the spring gate does not have to be bent or deformed in any way in order for it to be attached to the buckle. The spring gate is placed onto the catch by rotating the gate around until it rests under the catch, which is preferably in the form of a downward-facing hook. The pressure created by pressing on the spring gate deforms the spring, as it cannot move within the guide track due to the protrusion blocking the guide track. The spring then stores a restoring force that helps to remove the spring from the catch once the top bar is pressed downward sufficiently to release the spring gate from the catch.

The connection between the spring gate and the catch prevents any straps inserted into the second slot from sliding out of the buckle through the open end.

The spring gate is preferably formed from a metal wire that is bent into a loop with overlapping end portions. Each of end portions of the spring gate have extensions that extend perpendicular to a circumferential direction of the spring gate and in opposite directions to each other, so as to form an essentially Z-shaped profile. These extensions serve to anchor the spring gate in the guide track when the buckle is subject to force from straps being pulled. To receive the extensions, the top bar contains grooves in communication with the guide track, which receive the extensions of the spring gate when the spring gate is positioned at the distal end of the guide track. Force on the top bar away from the main body presses the extensions deeper into the grooves to prevent the spring gate from opening. Furthermore, this pressure from a strap presses on the top bar to compress the guide track and further anchor the spring gate in place.

There is preferably a reinforcing protrusion on a bottom surface of the guide track at an opposite end of the protrusion, so that excessive force on the top bar does not damage the portion below the guide track.

The present invention has the distinct advantages over the prior gated buckles, as the spring gate locking element of the present invention does not need to be deformed during assembly, and it cannot be inadvertently released due to large forces on a strap connected to the buckle. Furthermore, the gate is simple to assemble with the buckle, and does not require the formation or assembly with small holes in the buckle.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

and

Figure 12:
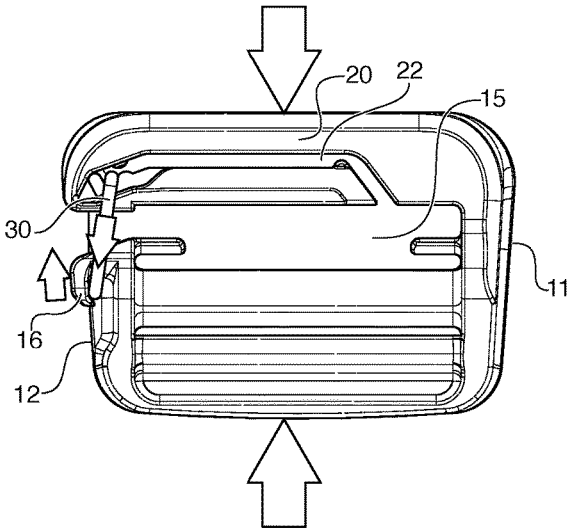

FIG. 12 shows the closure element being released from the catch by pressing down on the top bar of the buckle.

DETAILED DESCRIPTION OF THE PREFERRED EMBODIMENT

Figure 1:
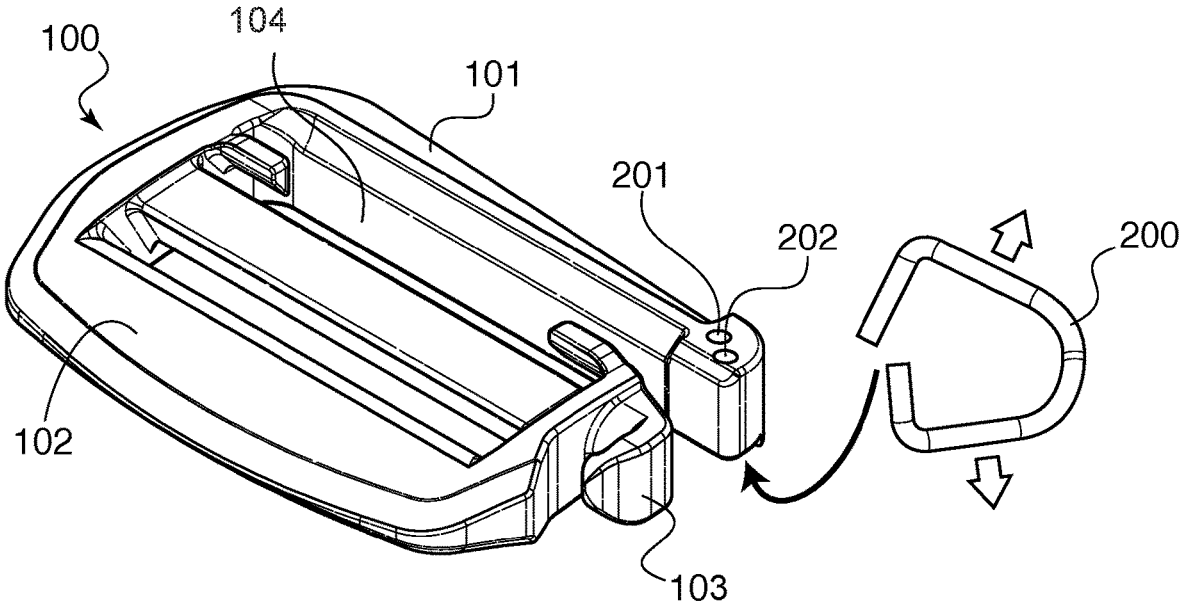
FIG. 1 ( Prior Art )
FIG. 1 shows a prior art buckle assembly.

Referring now in detail to the drawings and, FIG. 1 shows a prior art buckle 100, which has a main body 102 connected to a top bar 101. A spring gate 200 is connected to the free end of top bar 101 by deforming the spring gate 200 until the ends are spaced apart enough to be inserted into holes 201 and 202 of top bar 101. Once spring gate 200 is connected to top bar 101, it can be used to close the opening into the slot 104, by hooking spring gate 200 around catch 103. The drawback to this design is that the deformation of the spring gate 200 leads to some unreliability of the spring gate, as it does not always snap back to its original shape once it is fully assembled onto top bar 101. Furthermore, vertical pressure such as from straps connected to the buckle and to top bar 101 can force the ends of the spring gate 200 to bend and slip out of the holes 201, 202, which can then lead to failure of the buckle and release of any attached straps.

Figure 2:
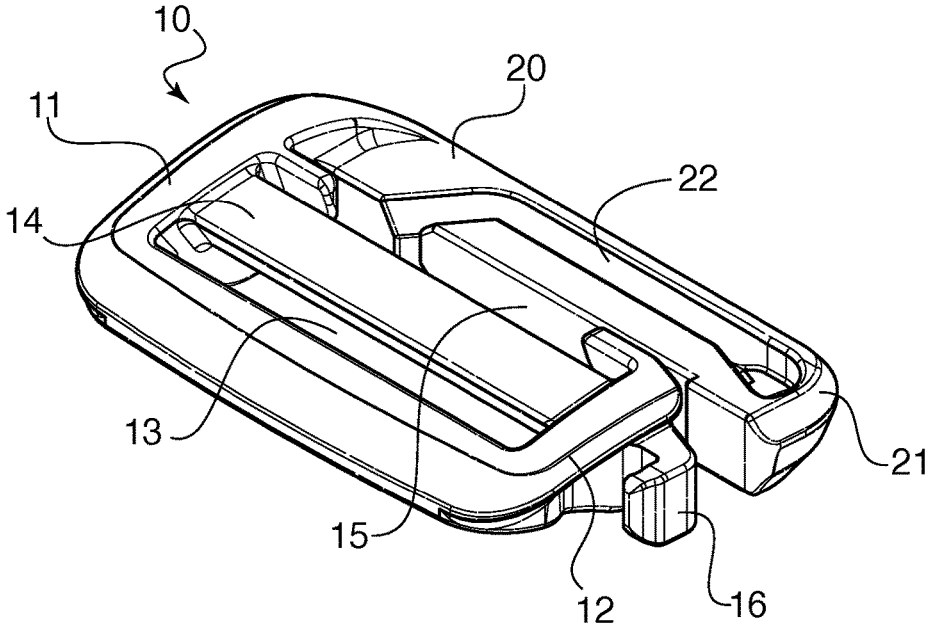
FIG. 2 shows a perspective view of the buckle according to the invention without the spring gate closure element.
Figure 3:
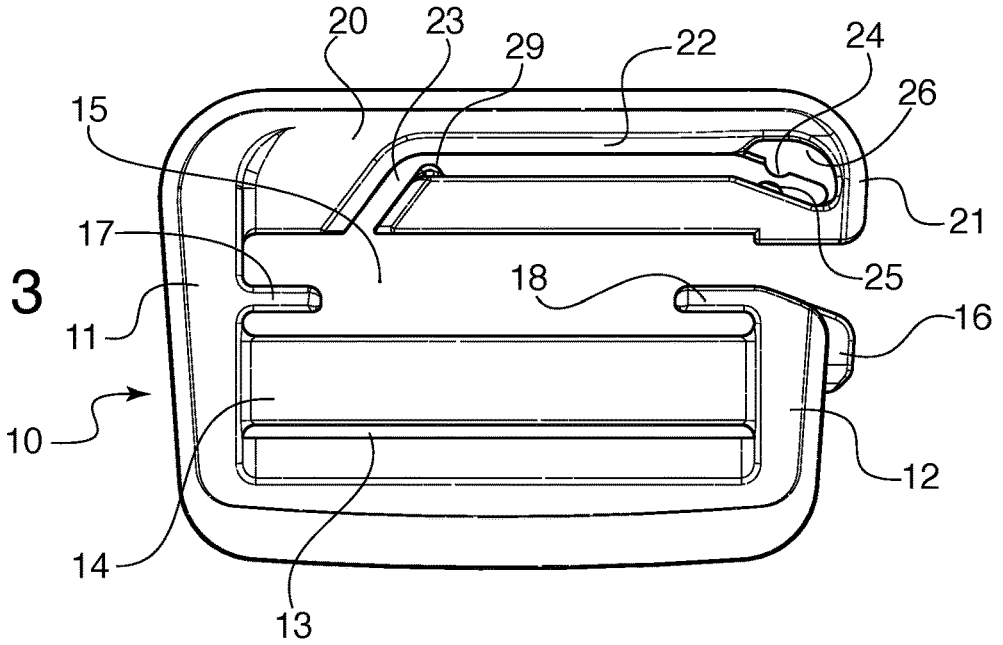
FIG. 3 shows another view of the buckle without the spring gate closure element.

The buckle of the present invention solves this problem through the use of a novel guide track in the top bar as well as a novel gate structure. The buckle of the present invention is shown in FIGS. 2-12. Here, as shown in FIGS. 2 and 3, buckle 10 has a main body consisting of side walls 11, 12 with a first slot 13 for receiving a strap. A central bar 14 spans first slot 13 and allows for strap adjustment as needed and arms 17, 18 keep the strap in place. Connected to side wall 11 is a top bar 20, which extends toward side wall 12 but is not connected to side wall 12. A second slot 15 is disposed between arms 17, 18 and top bar 20. Second slot 15 is open on its end adjacent side wall 12. A catch 16 in the form of a downward facing hook is disposed on side wall 12. Inside top bar 20 is a guide track 22 that runs parallel to the extent of top bar 20 and second slot 15. Guide track 22 is connected to second slot 15 by a guide slot 23, which is arranged at an oblique angle to guide track 22.

A lower protrusion 25 and an upper protrusion 24 are arranged at a distal end of the guide track, facing each other, to create an area of reduced width in guide track 22. A groove 26 is formed in top bar 20, which extends into guide track 22, which assists in holding spring gate 30, discussed below, in place. A corresponding groove is located on the opposite face of top bar 20 (not shown)

Figure 4:
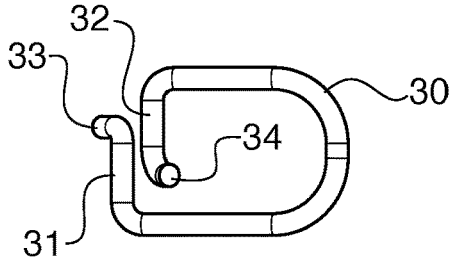
FIG. 4 shows a top view of the spring gate closure element.
Figure 5:
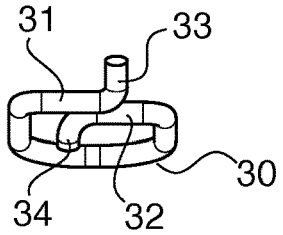
FIG. 5 shows a front view of the spring gate closure element.

FIGS. 4 and 5 show spring gate 30, which is formed of a metal wire or other elongated structure that is bent into a D-shape with overlapping end portions 31, 32. Each end portion 31, 32 has an extension 33, 34, respectively that extends perpendicular to the plane of spring gate 30, with each extension facing opposite the other, creating a Z-shaped profile.

Figure 6:
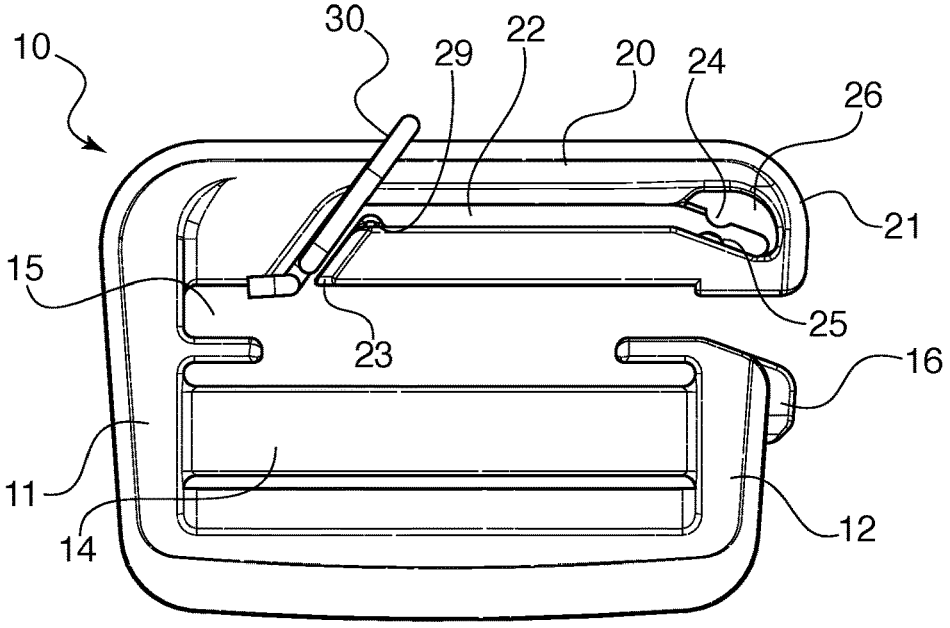
FIG. 6 shows the spring gate closure element being assembled into the guide track of the buckle.
Figure 7:
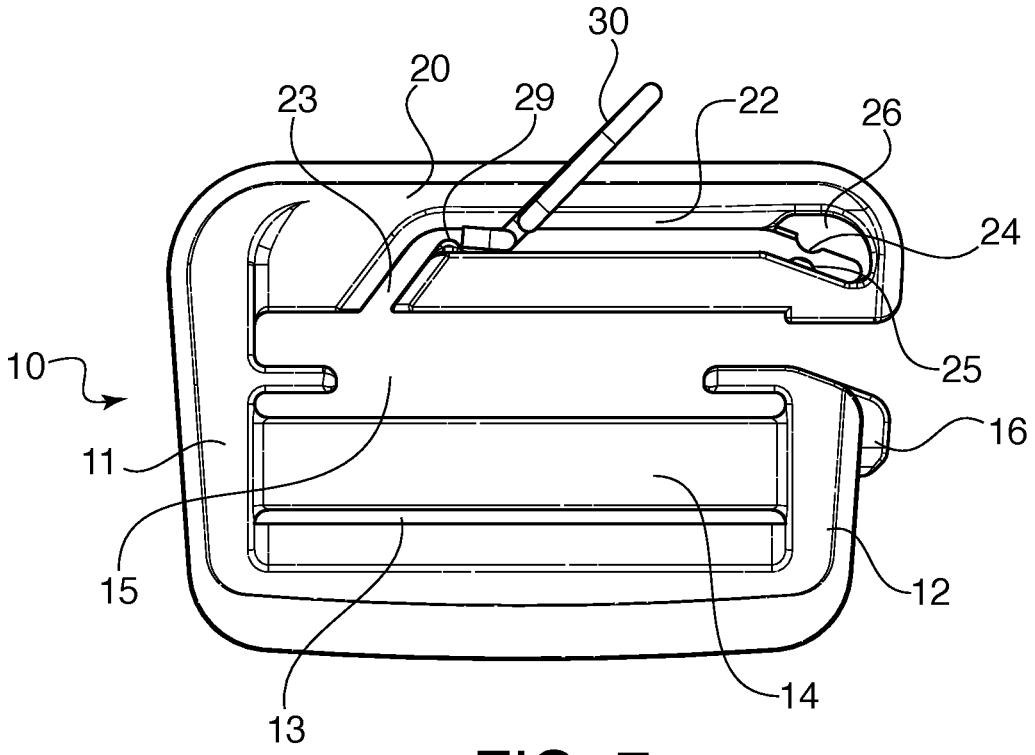
FIG. 7 shows the spring gate closure element moving along the guide track of the buckle toward the distal end.
Figure 8:
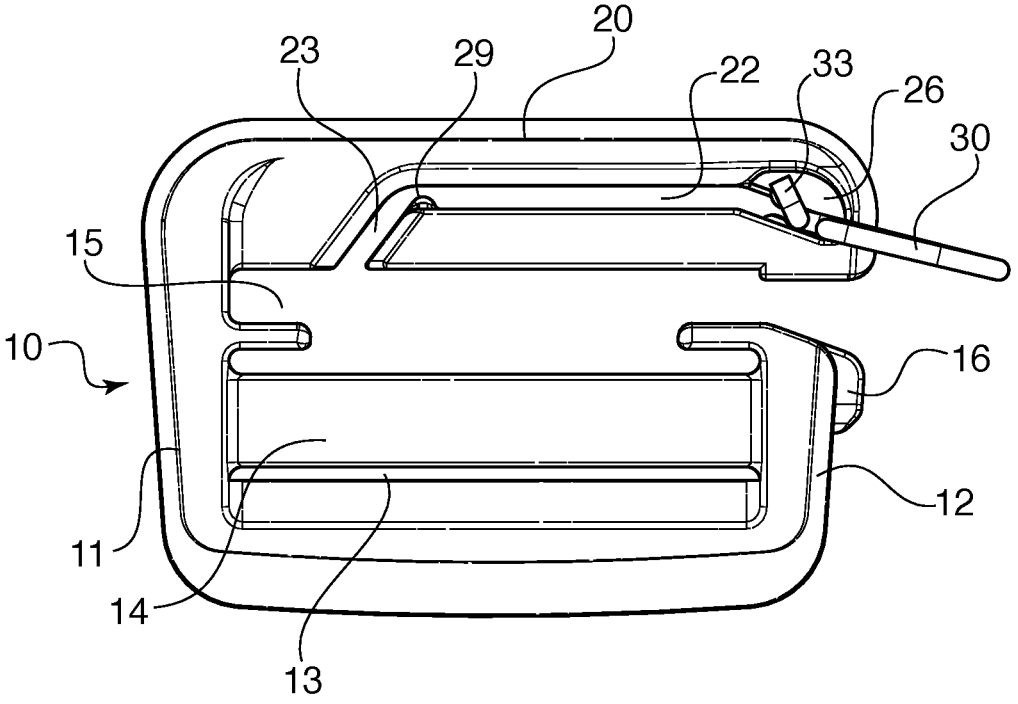
FIG. 8 shows the spring gate closure element in its assembled position in the guide track.

The assembly of spring gate 30 with buckle 10 is shown in FIGS. 6-9. As shown in FIG. 6, spring gate 30 is slid onto top bar 20 via open slot 15 and then fed into guide slot 23 and up into guide track 22. Spring gate 30 then slides along guide track 22 as shown in FIG. 7 until it reaches the distal end, at which it passes through protrusions 24, 25 under increased force, to reach the end of guide track 22, as shown in FIG. 8. Protrusions 24, 25 prevent spring gate 30 from sliding back along guide track 22 during use of the buckle 10. As shown in FIG. 8, extension 33 of spring gate 30 rests in groove 26 of top bar 20, and a corresponding groove 28 on the rear side of top bar 20 receives extension 34 as well.

Figure 9:
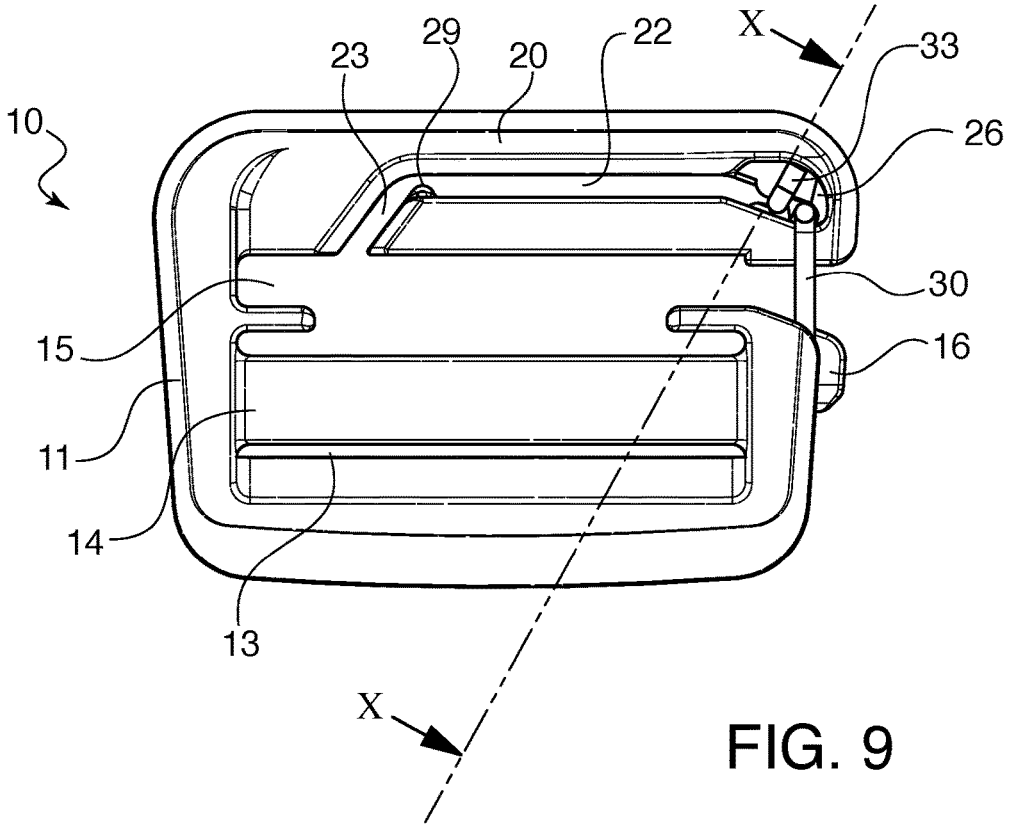
FIG. 9 shows the buckle in a locked position.
Figure 10:
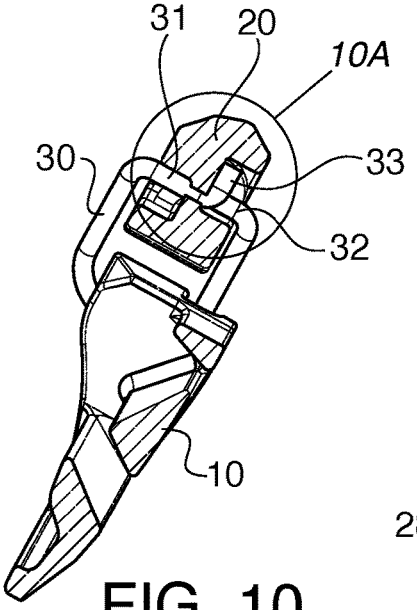
FIG. 10 shows a cross-sectional view along lines X-X of FIG. 9.
Figure 10A:
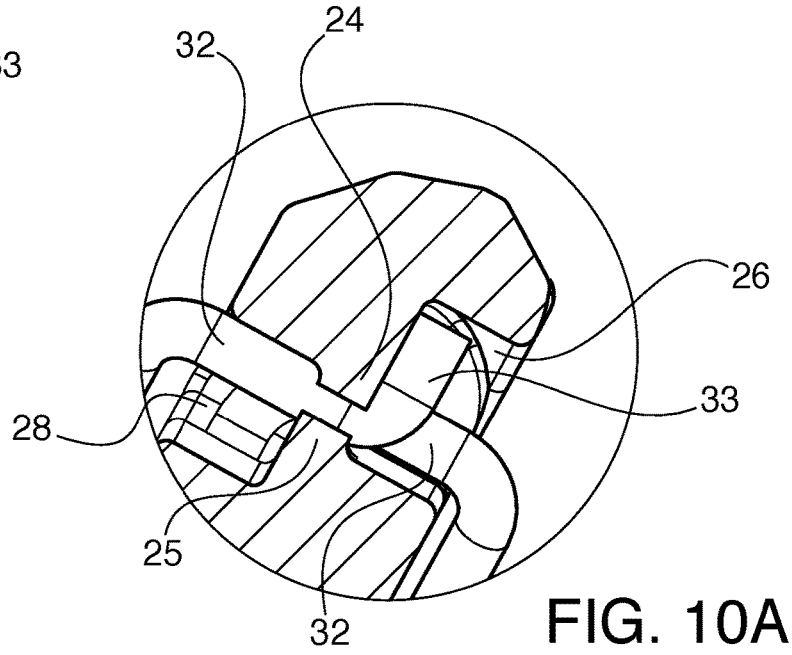
FIG. 10A shows an enlarged view of circle 10A of FIG. 10.

To lock buckle 10, spring gate 30 is rotated around top bar 20 until it passes over catch 16, at which time the hook on catch 16 locks spring gate 30 in place, as shown in FIG. 9. In the locked position, the extensions 33, 34 of spring gate 30 are pressed firmly against top bar 20 within grooves 26 and 28, preventing any movement of spring gate 30 during use, as can be seen in the cross-sectional views of FIGS. 10 and 10A.

Figure 11:
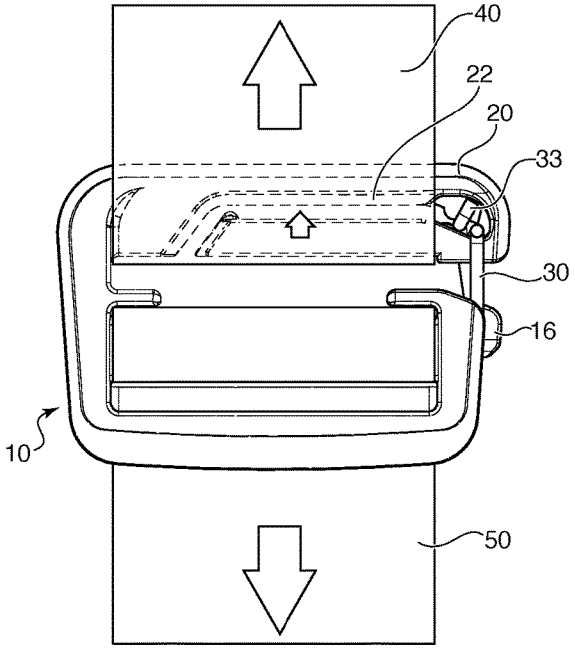
FIG. 11 shows the buckle having attached straps being pulled in opposite directions.

During use, strap 40 is looped around top bar 20 and strap 50 is threaded around central bar 14 in slot 13 as shown in FIG. 11 to connect two items together. When straps 40 and 50 are pulled in opposite directions along the arrows in FIG. 11, which is the typical case, the force of strap 40 on the underside of top bar 20 causes the underside of top bar 20 to bend slightly and compress guide track 22. This compression further secures spring gate 30 in place on buckled 10. To prevent excessive compression under heavy loads, an additional protrusion 29 can be supplied in guide track 22 adjacent guide slot 23, as shown for example in FIG. 9.

In addition to the compression of guide track 22, the upward force of the strap 40 on top bar 20 pulls on spring gate 30, which forces extensions 33, 34 of spring gate 30 even more tightly against top bar 20, so that inadvertent release of spring gate 30 from top bar 20 is prevented.

In order to release spring gate 30 from catch 16, the user simply presses down on top bar 30, as shown in FIG. 12, until spring gate 30 clears catch 16. The pressure of extensions 33, 34 against the walls of the grooves 26, 28 in top bar 20 creates a restoring force that allows spring gate 30 to then spring away from catch 16 to allow access to slot 15.

The present invention provides a simple and secure way to provide a closure system in a buckle, in which the spring gate is resistant to deformation even under large loads.

Accordingly, while only a few embodiments of the present invention have been shown and described, it is obvious that many changes and modifications may be made thereunto without departing from the spirit and scope of the invention.

What is claimed is:

1. A buckle comprising:

a main buckle body having a first side wall, a second side wall, and at least one first slot for receiving a first strap, a top bar connected to the main buckle body at the first side wall and forming a second slot with the main buckle body for receiving a second strap, wherein the second slot is open at a distal end thereof, wherein the top bar has a guide track extending longitudinally therethrough, the guide track opening into the second slot;

a catch formed on the second side wall adjacent the distal end of the second slot; and a spring gate in the shape of a loop with overlapping end portions, the spring gate being configured to be assembled with the main buckle body by inserting the spring gate in the guide track and sliding the spring gate to a distal end of the guide track, wherein the spring gate is configured to be placed around the catch to close the distal end of the second slot and wherein the spring gate is releasable from the catch by pressing on the top bar.

2. The buckle according to claim 1, wherein there is at least one protrusion extending into the guide track at the distal end of the guide track to keep the spring gate at the distal end of the guide track.

3. The buckle according to claim 2, further comprising a reinforcing protrusion on a bottom surface of the guide track at an opposite end of the at least one protrusion.

4. The buckle according to claim 1, wherein the end portions of the spring gate have extensions that extend perpendicular to a circumferential direction of the spring gate and in opposite directions to each other.

5. The buckle according to claim 4, wherein the top bar contains grooves in communication with the guide track, the grooves being configured to receive the extensions of the spring gate when the spring gate is positioned at the distal end of the guide track, such that force on the top bar away from the main body presses the extensions deeper into the grooves to prevent the spring gate from opening.

6. The buckle according to claim 1, wherein the guide track connects to the second slot at an oblique angle to a longitudinal extension of the guide track.

7. The buckle according to claim 1, wherein the catch is in the form of a hook that faces away from the top bar.

8. The buckle according to claim 1, further comprising a first strap extending through the first slot and around the main buckle body, and a second strap extending through the second slot and around the top bar, wherein tension on the straps in opposite directions presses the second strap against the top bar and compresses the guide track.

9. The buckle according to claim 1, wherein the spring gate is formed from metal wire.

* * * * *